United States Patent [19]

Odermann

[11] Patent Number: 4,503,793

[45] Date of Patent: Mar. 12, 1985

[54] BOBBIN WINDING ACTUATION BY BUTTONHOLE SELECTION

[75] Inventor: Charles R. Odermann, Montville, N.J.

[73] Assignee: The Singer Company, Stamford, Conn.

[21] Appl. No.: 525,869

[22] Filed: Aug. 24, 1983

[51] Int. Cl.[3] ..... D05B 59/00; D05B 3/06; D05B 69/02

[52] U.S. Cl. ..... 112/262.1; 112/221; 112/264.1; 112/279

[58] Field of Search ..... 112/184, 186, 158 B, 112/264.1, 279, 221, 262.1

[56] References Cited

U.S. PATENT DOCUMENTS

| | | | |
|---|---|---|---|
| 3,143,093 | 8/1964 | Parry | 112/221 X |
| 3,693,566 | 9/1972 | Ketterer | 112/184 |
| 4,138,955 | 2/1979 | Garron | 112/221 X |
| 4,159,688 | 7/1979 | Garron et al. | 112/264.1 |
| 4,188,900 | 2/1980 | Garron et al. | 112/264.1 |
| 4,216,733 | 8/1980 | Kornatowski | 112/184 |
| 4,327,654 | 5/1982 | Odermann et al. | 112/158 E |
| 4,359,954 | 11/1982 | Dreier | 112/221 |

*Primary Examiner*—Wm. Carter Reynolds

*Attorney, Agent, or Firm*—Edward P. Schmidt; Robert E. Smith; Edward L. Bell

[57] ABSTRACT

A method for implementing winding of a lower thread bobbin in place in a looptaker of a sewing machine from an upper thread supply. A buttonhole pattern in which at least one initial stitch is effected at one end of the buttonhole prior to holding needle bar reciprocation in abeyance while feeding the work material to the other end of the buttonhole, is selected but is utilized without a traveling buttonhole foot which would reinitiate stitching and feeding of the work material. Instead, any other presser foot, or no presser foot, is used so that bobbin winding may proceed after upper thread is initially brought to the lower bobbin, without having thread flow interferred with by needle bar reciprocation.

1 Claim, 5 Drawing Figures

BOBBIN WINDING ACTUATION BY BUTTONHOLE SELECTION

BACKGROUND OF INVENTION

This invention is in the field of sewing machines; more particularly, it is concerned with a simplified method for implementing bobbin winding in place in a looptaker of a family sewing machine.

In the prior art, there are many examples of lock stitch sewing machine looptakers having the capability to replenish bobbin thread while the bobbin remains in place in the looptaker. An example of this prior art is found in the U.S. Pat. No. 3,693,566, issued on Sept. 26, 1972 to Ketterer.

In a prior art family lock stitch sewing machine using the capability disclosed in the above referred to patent, several steps were required to initiate the bobbin winding process. After the need for lower thread was perceived, the first step required in this electronically controlled prior art sewing machine, was firstly, to raise the presser foot so as to release the tension from the tension discs to allow thread to run freely from the upper large thread supply through the needle eye to the lower thread bobbin. Secondly, it was required to open the bed slide plate of the sewing machine to expose the bobbin winding mechanism therein and to actuate the bobbin winding latch to the winding position. Thirdly, a blind stitch pattern was selected in which several stitches are skipped and a small number of stitches are made in a continuous sequence. In this way, a stitch sequence could be provided in which an upper thread was brought down to the sewing machine looptaker in order to load an upper thread on the bobbin as is taught in the above referenced patent. Fourth, a single pattern repeat symbol must also be selected which will provide that only a single blind stitch sequence would be implemented so that a repeat up and down motion of the needle which might impede a smooth flow of thread from the spool to the bobbin, could be avoided. Fifthly, a thread ending from the sewing needle eye must be drawn beneath the elevated presser foot and wrapped around the thumb retaining screw for the presser foot, in order to provide a sufficient tautness to the trailing thread for a loop to be thrown that might be picked up by the looptaker.

It would be advantageous to simplify the above process insofar as possible. Many of the above steps, however, are not readily eliminated since the thread tension must be released, a bobbin winding mechanism must be armed and, steps must be taken to insure that a thread loop is provided for the looptaker. Further, in a sewing machine not having a single pattern repeat capability, some other means must be found for limiting the up and down motion of the needle which might interfere with the smooth flow of thread to the bobbin.

What is required is a method for implementing bobbin winding which might be implemented in a sewing machine not having pattern repeat capability without sacrificing any of the above noted requirements.

SUMMARY OF THE INVENTION

The above requirements are attained in a sewing machine not having single pattern repeat capability, but having the capability to implement a one-step buttonhole having legs comprised of cording stitches and overlay stitches over the cording stitches which are actuated in the forward direction for optimum appearance. In the U.S. Pat. No. 4,188,900, there is disclosed the expedient for initiating such a buttonhole adjacent a fabric edge by first implementing a bar tack end, followed by skip stitch feeding of the work material to the opposite end of the fabric so that cording stitches may be effected in the reverse direction and overlay stitches in the forward direction. In implementation of a buttonhole, a traveling buttonhole foot is provided having stop members thereon positioned by a button of a size to be accommodated by the buttonhole, which stop members initiate reversal of the sewing machine feed at the appropriate location to begin the next step of the buttonhole. By a modification of the steps of the buttonhole to provide for the initiation of the buttonhole adjacent a fabric edge by the placement of one or two stitches in center needle position, followed by skip stitch feeding of the work material to the opposite end of the fabric, and by non-use of a traveling buttonhole foot, the buttonhole pattern selection might be utilized in conjunction with any other presser foot to implement bobbin winding without any other modification to the sewing machine. Thus, two stitches at center needle position might be utilized to initially bring the upper thread to the lower bobbin for placement thereon, and the continuous skip stitching thereafter implemented will provide for uninterrupted flow of thread from the upper thread spool to the bobbin.

DETAILED DESCRIPTION OF THE INVENTION

With the above and additional objects and advantages in view, as will hereinafter appear, this invention will now be described with reference to the accompanying drawings of a preferred embodiment in which.

Figure 1:
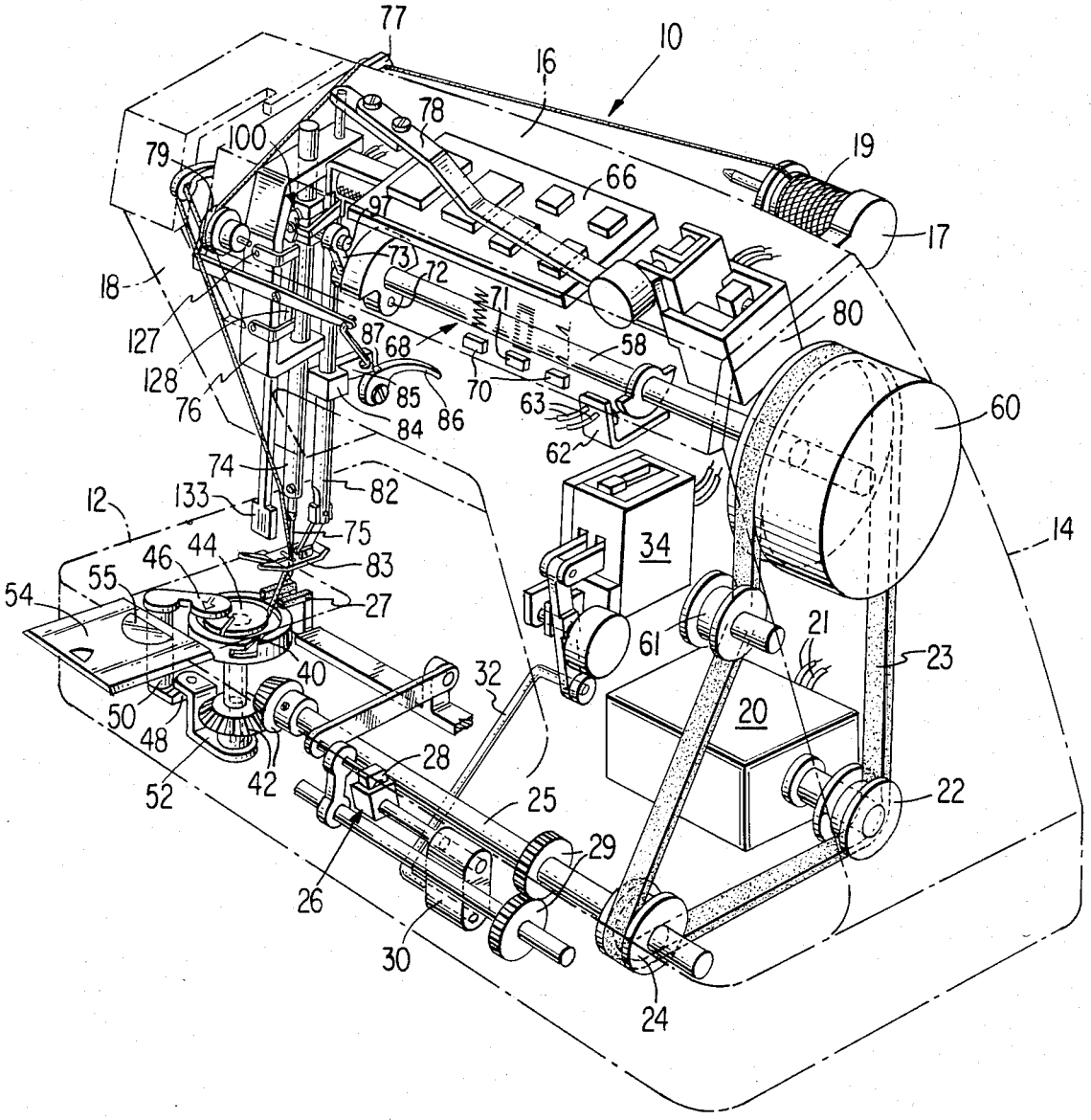
FIG. 1 is a perspective view of a sewing machine implementing the present invention in which the frame is shown in phantom to provide the inner details of the sewing machine.

Referring to FIG. 1, there is disclosed a sewing machine 10 having a frame shown in phantom and including a bed 12 from one end of which there rises a standard 14 to support a bracket arm 16 in overhanging relationship to the bed, the bracket arm terminating in head 18. Supported in the bed 12 is a motor 20, the electric leads 21 of which may be connected to a source of power in a manner well known in the sewing machine art so as to selectively actuate the sewing machine 10. The motor 20 is connected by means of pulley 22 and timing belt 23 to a drive pulley 24 for a drive shaft 25 connected by gearing 29 to a sewing machine feed system 26 which terminates in feed dog 27. The feed system 26 may, typically, be provided with a slide block and slide arrangement 28 providing a means to vary the extent and direction of the feed by the feed dog 27. Selective rotation of the slide block and slide arrangement 28 to vary feed is provided through a lever 30 connected to the slide block and slide arrangement and having the other end thereof connected by link 32 to a feed linear motor 34 which may be directed by an electronic control to position the slide block and slide arrangement 28 in a selected discrete position. A typical feed system 26 which might be implemented in the bed 12 of the sewing machine 10 is one similar to that disclosed in the U.S. Pat. No. 3,527,183, which issued on Sept. 8, 1970 to Szostak, and which is hereby incorporated by reference herein.

Also supported within the bed 12 is a looptaker 40 which is driven by way of bevel gear connection 42 to the drive shaft 25. Supported within the looptaker 40 is a bobbin 44. A wind lever 46 is provided which may be shifted in a counterclockwise direction to allow entry of the bobbin 44 into the looptaker 40, or may be shifted to a central position to retain the bobbin 44 therein. The wind lever 46 may also be shifted to an extreme clockwise position, as viewed in FIG. 1, in which a cam 48 situated on the end of a shaft 50 to which the wind lever 46 is attached, urges a bracket 52 upwardly to bring post (not shown), which is situated centrally of the looptaker 40, into engagement with the bobbin 44 to initiate rotation thereof for the purpose of winding upper thread on the bobbin to provide a source of lower thread for a lock stitch. Further particulars on a specific desirable arrangement for replenishing bobbin thread may be had by reference to the U.S. Pat. No. 3,693,566, issued on Sept. 26, 1972 to Ketterer, which patent is hereby incorporated by reference herein. A bed slide plate 54 is provided on bed 12 which may be slid away from the looptaker 40 and wind lever 46 in order to expose the same for initiation of the bobbin winding process or for any required maintenance of the mechanisms in that area. The bed slide plate 54 is provided with a window 55 by which the status of the lower thread supply on the bobbin 44 may be monitored.

Supported within the bracket arm 16 is a horizontal arm shaft 58 which is connected to the motor 20 by a handwheel pulley combination 60, and in which the belt 23 is engaged with the pulley portion thereof. An idler pulley 61 is provided so that an efficient motion transmitting arrangement may be maintained between the electric motor 20 and drive shaft 25 and horizontal arm shaft 58. The horizontal arm shaft 58 supports thereon a portion of a pulse generator 62 which is connected by leads 63 to an electronic control arrangement 66 also supported in the bracket arm 16. The pulse generator 62 provides, for example, a signal synchronized to the operations of the sewing machine 10, and provides a synchronization signal to the electronic control arrangement 66 so as to allow the electronic control arrangement to, for example, initiate operation of the feed linear motor 34 at the proper time in the sewing cycle to vary the extent and direction of the feeding motion implemented by the feed dog 27. The bracket arm 16 includes a control panel 68 supporting therein pattern selection buttons 70 including buttonhole selection button 71, which buttons are also connected to the electronic control arrangement 66 in order to provide for the transfer of specific pattern information from the electronic control arrangement 66 to the linear motors of the sewing machine. More specific information on a particular electronic control arrangement 66 may be had by reference to U.S. Pat. Nos. 3,847,100 and 3,872,808, issued on Nov. 12, 1974 and Mar. 25, 1975, respectively, and assigned to the assignee of this invention, which patents are hereby incorporated by reference herein.

In the head 18, the arm shaft 58 terminates in a crank 72 which is connected by link 73 to a needle bar 74 supported for endwise reciprocation in a needle bar gate 76 carried for oscillation on pivot element 53 (see FIG. 3) in the head end 18. The needle bar 74 terminates in a sewing needle 75, which sewing needle cooperates with the looptaker 40 supported in the bed 12 of the sewing machine in the formation of lock stitches. The needle bar gate 76 is urged into selective oscillation by the connections of a driving arm 78 thereto, which driving arm is operatively connected to a bight linear motor 80 also operating under the control of the electronic control arrangement 66 to influence selective oscillations of the needle bar gate and selective lateral motion of the needle bar 74 and sewing needle 75 affixed thereto. Supported in the head 18 behind the needle bar 74, is a presser bar 82 which is visible in FIG. 1 and terminates in a presser foot 83. The presser bar 82 has affixed thereto a presser bar guide bracket 84, which guide bracket is fashioned with a rearwardly directed arm 85 designated for engagement with a cam surface 87 of a presser bar lift lever 86, so that the presser foot 83 affixed to the end of a presser bar 82 might be elevated out of contact with the work material supported on the sewing machine bed 12.

Supported on the back of the bracket arm 16 is a thread post 17, on which post is supported an upper thread spool 19. Thread from the thread spool 19 extends to pivot 77 on the back of head 18, and from there to the tension discs of a conventional tension 79 supported in the top front of the head. In the usual fashion in sewing machines, the thread thereafter passes to a conventional sewing machine take up (not shown) and then to the eye (not shown) of the sewing needle 75.

Figure 3:
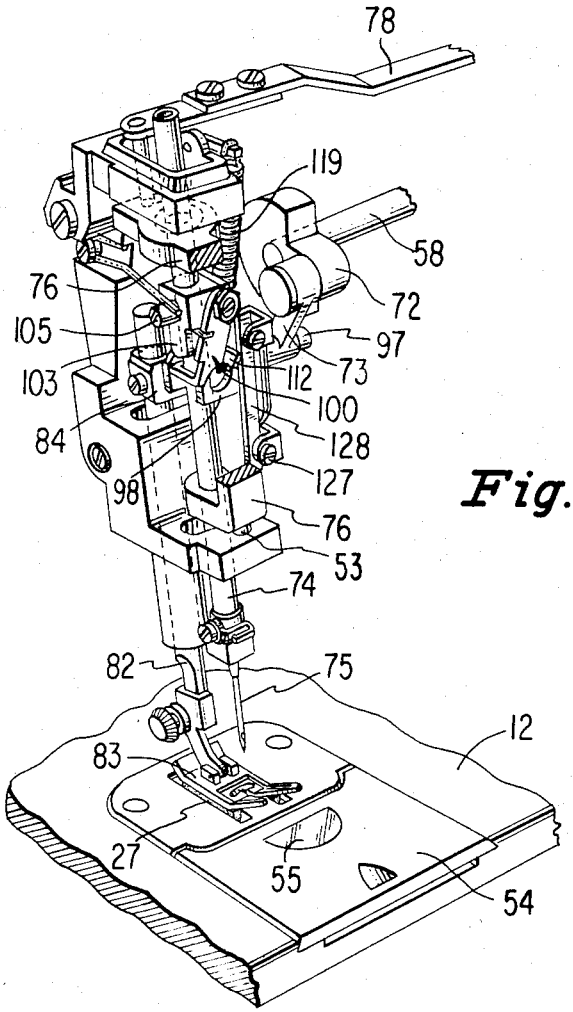
FIG. 3 represents a perspective view of the basting stitch initiated by needle bar overthrow illustrating the needle bar latch being driven into the disconnected position.
Figure 2:
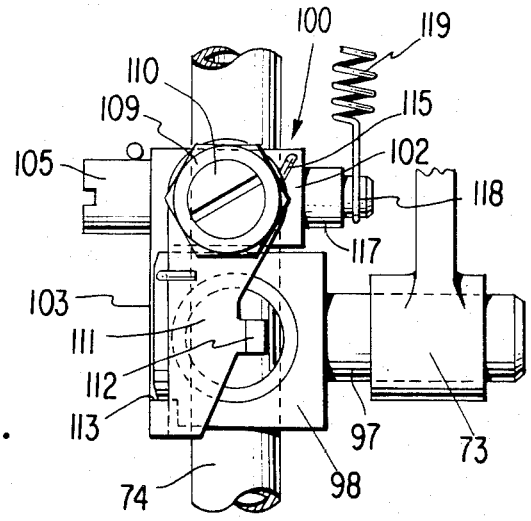
FIG. 2 is an elevation of the latch mechanism carried by the needle bar shown in FIG. 1 and connecting the same to the drive mechanism for the sewing machine.

Referring now to FIG. 2, there is shown the connection between the link 73 of FIG. 1 and the needle bar 74, which is implemented by a latch mechanism 100 affixed to the needle bar 74 in its upper portion (see FIGS. 2 and 3). A rectangular collar 102 having a downwardly extending tang 103 which is received in a bifurcated portion 98 of a driving stud 97, contains a threaded hole which receives a screw 105 having an elongated head portion. The link 73 is shown connected in FIG. 1 to the driving stud 97. The screw 105 extends through the threaded hole in the rectangular collar 102 and firmly attaches the collar to the needle bar 74. Located on the front side of the rectangular collar 102 and supported on eccentric collar 109, held positioned to the rectangular collar by a screw 110, is a latch lever 111. The latch lever 111 has forwardly extending ear 112 spaced from the eccentric collar 109 and a rearwardly extending lug having a latch surface 113 located a sufficient distance from the eccentric collar 109 to clasp the lower edge of the bifurcated portion 98 of the driving stud 97 when the bifurcated portion is in intimate contact with the lower surface of the rectangular collar 102. Adjustments for proper clearance between the latch surface 113 and bifurcated portion 98 are provided for a rotation of the eccentric collar 109 on which latch lever 111 is supported and tightening of the screw 110 to hold the eccentric collar 109 in the selected adjusted position.

Also supported by eccentric collar 109 and biased on the rectangular collar 102 is a torsion spring 115. The torsion spring 115 biases the latch lever 111 in counterclockwise direction, as viewed in FIG. 2, thereby to engage the rearwardly extending latch surface 113 onto the bifurcated portion 98 of the driving stud 97. Opposite the screws 105 of the rectangular collar 102 is a post 117 extending from the collar 102, which post 117 contains a peripherial groove 118 on its end. The peripherial groove 118 receives one end of a needle bar elevating spring 119, the other end of which is supported on the sewing machine frame. The spring 119 serves to elevate the needle bar 74 whenever the latch surface 113 is disengaged from the bifurcated portion 98 of the driving latch 97.

The needle bar gate 76 has attached by screws 127 to the front thereof a latch release abutment member 128 which extends around the gate to the inside thereof adjacent the forwardly extending ear 112 of the latch lever 111 (see FIG. 3. As explained in the U.S. Pat. No. 3,782,311, issued on Jan. 1, 1974 to Adams et al, and assigned to the assignee of this invention, and incorporated herein by reference thereto, movement of the gate 76 on its support bearings will cause the latch release abutment member 128 to have a portion thereof strike the forwardly extending ear 112 of the latch lever 111 and separate the latch surface 113 of the rearwardly extending lug from the lower edge of the bifurcated portion 98 of the driving stud 97, thus permitting the needle bar elevating spring 119 to draw the needle bar 74 into an elevated position.

In order to have the needle bar gate 76 move to the position just described so as to disconnect the needle bar 74 from the driving stud 107, the driving arm 78 must move to the right as viewed in FIG. 3 and beyond the normal range of jogging motion for the sewing needle 75. A fuller explanation of the manner in which this is implemented may be had by reference to the U.S. Pat. No. 4,327,654, issued on May 4, 1982, to Odermann et al, and assigned to the assignee of the present application, and which is hereby incorporated by reference herein.

Figure 4:
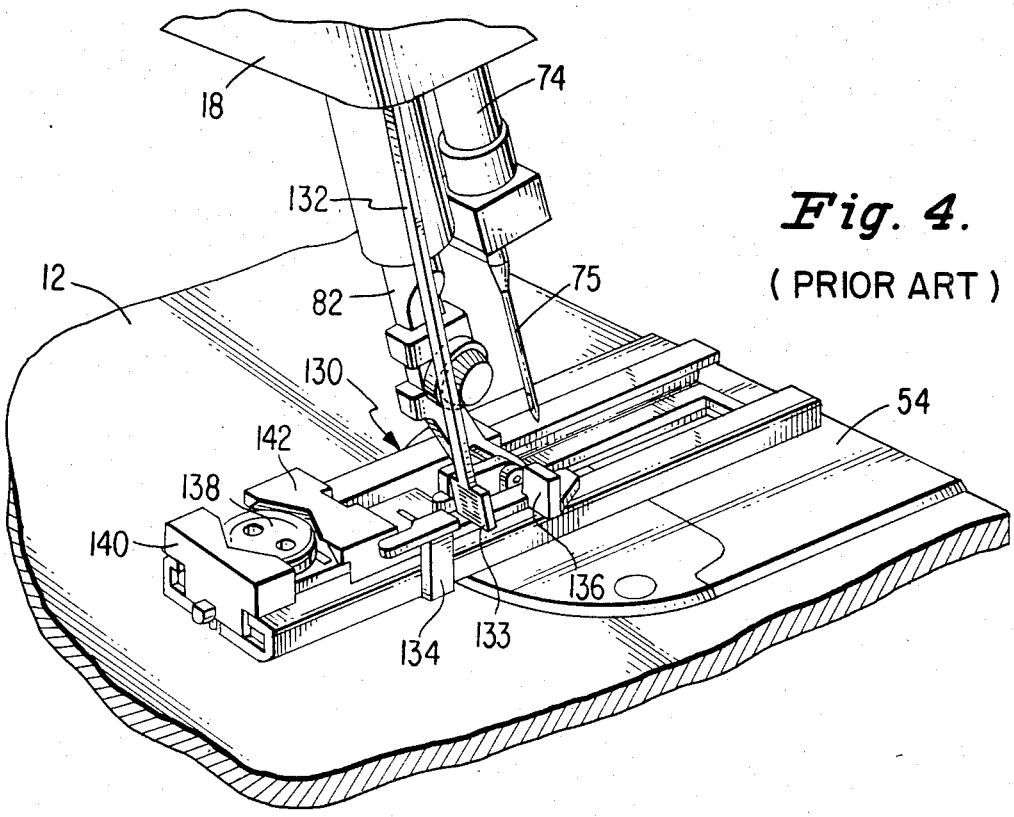
Fig. 4. ( PRIOR ART )
FIG. 4 is a rear persepctive view of a prior art traveling buttonhole foot for disclosing a manner in which turnaround at buttonhole ends is normally achieved; and, FIG. 5 is a representation of the buttonhole pattern produced by the sewing machine, the characteristics of which are utilized in initiating bobbin winding.

Referring now to FIG. 4, there is disclosed a traveling buttonhole presser foot 130 which is not necessary to practice of invention but is disclosed herein to provide a description of the manner of operation of the invention and for an understanding thereof. In FIG. 4, the sewing machine head 18 is disclosed with the needle bar 74 extending therefrom and terminating in the sewing needle 75, as well as the presser bar 82 to which the traveling buttonhole presser foot 130 is attached. Also visible in FIG. 4 is a bar 132 having at the end thereof a paddle 133. A bar 132 and paddle 133 are shown in the extending position in both FIGS. 1 and 4 although it is known that the bar may be shifted into the head 18 so that only the paddle 133 extends therebeneath. In the extended position for the bar 132 as shown in FIGS. 1 and 4, the paddle 133 extends between a fixed rear step member 134 and a shiftable front stop member 136, which front stop member is position by insertion of a button 138 between anchor element 140 and buttonhole guaging element 142. In operation, the feed dog 27 of the sewing machine 10 shift the traveling buttonhole presser foot 130, and when the position of the paddle 133 is shifted by the engagement with the fixed rear stop member 134 or the front stop member 136, a turnaround is implemented by the shift of the sewing machine from reverse to forward stitching or from forward stitching to reverse stitching, respectively. For further information with respect to the operation of the bar 132 and paddle 133 with the traveling buttonhole presser foot 130, the reader is referred to the U.S. Pat. No. 4,159,688, issued on July 3, 1979 to Garron et al, and assigned to the assignee of the present invention, the disclosure of which application is hereby incorporated by reference herein.

Figure 5:
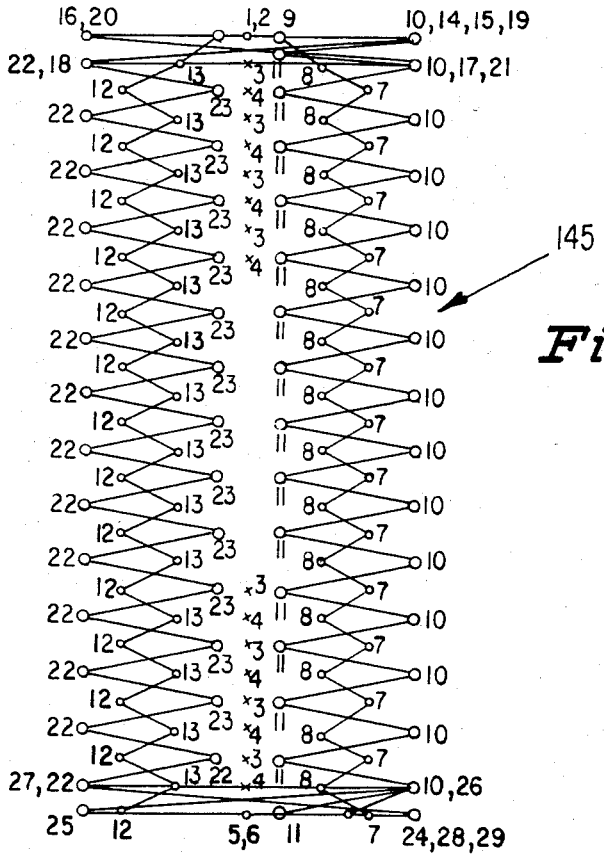

A buttonhole 145 which might be implemented with the traveling buttonhole presser foot 130 is indicated in FIG. 5. In this representation of the buttonhole 145, a stitch sequence 1 through 29 is indicated in which stitches one and two are made in center needle position, followed stitches 3 and 4 in a repeated sequence to obtain by a continuous feed to the opposite end of the buttonhole 145 with the latch mechanism 100 having the latch surface 113 disengaged from the bifurcated portion 98 of the driving stud 97, as shown in FIG. 3, so that endwise reciprocation of the needle bar 74 and the sewing needle 75 attached thereto is held in abeyance. If, as is shown in FIGS. 1 and 3, the traveling buttonhole presser foot 130 is not attached to the presser bar 82, but a conventional presser foot 83 is attached thereto, the endwise reciprocation of the needle bar 74 will be held in abeyance for as long as the sewing machine 10 is actuated by the motor 20 in as much as there is no fixed rear stop member 134, or front stop member 136, to engage the paddle 133 of the sewing machine 10 to reinitiate stitching in the numbered sequence beginning with the stitch 5 and in accordance with the stitch information for the buttonhole retained in and transferred from the electronic control arrangement 66. Of course, as taught in the U.S. Pat. No. 4,188,900, the need for holding stitching in abeyance is determined in a particular ornamental buttonhole by the need to initiate the buttonhole adjacent a garment edge and to have the final stitching take place in a forward direction for a more attractive appearance. Thus, by selection of the buttonhole pattern selection button 71, while a conventional presser 83 is affixed to the presser bar 82, and not a traveling buttonhole presser foot 130, an initial two stitches will be made in central needle position, to provide greater assurance that needle thread is engaged by the bobbin replenishment mechanism, after which the endwise reciprocation of the needle bar 74 is held in abeyance to facilitate travel of the thread through the eye of the sewing needle until such time as the bobbin 44 is filled.

I claim:

1. A method for implemnting winding of a lower thread bobbin in place in a looptaker of a sewing machine from an upper thread spool, said sewing machine having a frame, an endwise reciprocal needle bar supported by said frame, a sewing needle supported in the end of said needle bar to undergo endwise reciprocation, means for selectively actuating said needle bar in endwise reciprocation, a presser bar, means for selectively disconnecting said actuating means from said needle bar to suspend endwise reciprocation of said needle bar while continuing actuation of said actuating means, pattern selection means including a buttonhole pattern selector for implementing selective lateral oscillations of said needle bar and sewing needle affixed thereto, wherein the buttonhole pattern is of a variety in which at least one stitch is effected at a first end of the buttonhole after which the disconnecting means is actuated to feed the work material to the opposite end of the buttonhole as indicated by a traveling buttonhole foot having means thereon to reinitiate endwise reciprocation of the needle bar, the method comprising the steps of:

selecting said buttonhole pattern selector but without having said traveling buttonhole foot carried by said presser bar to reinitiate endwise reciprocation of said needle bar; and actuating said actuating means to initiate at least one stitch of said buttonhole in center needle position to bring upper thread down to said lower thread bobbin and thereafter disconnecting said actuating means from said needle bar to suspend endwise reciprocation of said needle bar while continuing actuation of said actuating means to implement winding in place of said bobbin.

* * * * *